US011808125B2

(12) United States Patent
Oehring et al.

(10) Patent No.: US 11,808,125 B2
(45) **Date of Patent: *Nov. 7, 2023**

(54) SMART FRACTURING SYSTEM AND METHOD

(71) Applicant: U.S. Well Services, LLC, Houston, TX (US)

(72) Inventors: Jared Oehring, Houston, TX (US); Alexander James Christinzio, Houston, TX (US); Brandon N. Hinderliter, Houston, TX (US)

(73) Assignee: U.S. Well Services, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/876,929

(22) Filed: May 18, 2020

(65) Prior Publication Data

US 2020/0386077 A1 Dec. 10, 2020

Related U.S. Application Data

(63) Continuation of application No. 16/170,695, filed on Oct. 25, 2018, now Pat. No. 10,655,435.
(Continued)

(51) Int. Cl.
*E21B 43/26* (2006.01)
*E21B 44/00* (2006.01)
*E21B 41/00* (2006.01)

(52) U.S. Cl.
CPC ..... *E21B 43/2607* (2020.05); *E21B 41/00* (2013.01); *E21B 43/26* (2013.01); *E21B 44/00* (2013.01)

(58) Field of Classification Search
CPC ..... E21B 43/26; E21B 43/2607; E21B 44/00
See application file for complete search history.

(56) References Cited

U.S. PATENT DOCUMENTS 2,976,025 A 3/1961 Pro
3,878,884 A 4/1975 Raleigh
(Continued)

FOREIGN PATENT DOCUMENTS

CA 3067854 A1 1/2019
CN 104117308 A 10/2014
(Continued)

OTHER PUBLICATIONS

Non-Final Office Action issued in U.S. Appl. No. 14/881,535 dated May 20, 2020.
(Continued)

*Primary Examiner* — Jennifer H Gay
(74) *Attorney, Agent, or Firm* — HOGAN LOVELLS US LLP

(57) ABSTRACT

A hydraulic fracturing system includes a plurality of pumps positioned at a wellsite and configured to pressurize a fracturing fluid, a distribution system fluidly coupled to receive and consolidate fracturing fluid from the plurality of pumps for injection into a wellhead. The hydraulic fracturing system further includes a control system, which includes a plurality of sensing devices configured to measure one or more parameters of the plurality of pumps and the distribution system, one or more processing device configured to receive and analyze the one or more parameters measured by the plurality of sensing devices and generate control instructions based at least in part on the one or more parameters, and one or more control device configured 110 to receive the control instructions and control one or more aspects of the plurality of pumps or the distribution system based on the control instructions.

20 Claims, 7 Drawing Sheets

Related U.S. Application Data

(60) Provisional application No. 62/577,056, filed on Oct. 25, 2017.

(56) References Cited

U.S. PATENT DOCUMENTS 4,411,313 A 10/1983 Johnson et al.
4,538,916 A 9/1985 Zimmerman
4,601,629 A 7/1986 Zimmerman
4,768,884 A 9/1988 Elkin
5,114,239 A 5/1992 Allen
5,334,899 A 8/1994 Skybyk
5,439,066 A 8/1995 Gipson
5,486,047 A 1/1996 Zimmerman
5,517,822 A 5/1996 Haws et al.
5,798,596 A 8/1998 Lordo
5,813,455 A 9/1998 Pratt et al.
5,950,726 A 9/1999 Roberts
6,035,265 A 3/2000 Dister et al.
6,097,310 A 8/2000 Harrell et al.
6,121,705 A 9/2000 Hoong
6,273,193 B1 8/2001 Hermann et al.
6,442,942 B1 9/2002 Kopko
6,585,455 B1 7/2003 Petersen et al.
6,626,646 B2 9/2003 Rajewski
6,765,304 B2 7/2004 Baten et al.
6,788,022 B2 9/2004 Sopko
6,985,750 B1 1/2006 Vicknair et al.
7,795,830 B2 9/2010 Johnson
8,506,267 B2 8/2013 Gambier et al.
8,763,387 B2 7/2014 Schmidt
8,774,972 B2 * 7/2014 Rusnak ..... F04D 15/0066 700/282
8,795,525 B2 8/2014 McGinnis et al.
9,051,923 B2 6/2015 Kuo
9,062,545 B2 6/2015 Roberts et al.
9,140,105 B2 9/2015 Pattillo
9,353,593 B1 5/2016 Lu et al.
9,482,086 B2 11/2016 Richardson et al.
9,506,333 B2 11/2016 Castillo et al.
9,650,871 B2 * 5/2017 Oehring ..... F04B 23/06
9,706,185 B2 7/2017 Ellis
9,739,546 B2 8/2017 Bertilsson et al.
9,790,858 B2 10/2017 Kanebako
9,840,901 B2 * 12/2017 Oehring ..... H02P 23/00
9,945,365 B2 4/2018 Hernandez et al.
9,970,278 B2 * 5/2018 Broussard ..... E21B 43/26
10,119,381 B2 * 11/2018 Oehring ..... F01D 15/08
10,184,465 B2 1/2019 Enis et al.
10,221,639 B2 3/2019 Romer et al.
10,302,079 B2 5/2019 Kendrick
10,408,030 B2 9/2019 Oehring et al.
10,408,031 B2 * 9/2019 Oehring ..... E21B 21/062
10,415,332 B2 9/2019 Morris et al.
10,627,003 B2 4/2020 Dale et al.
10,648,270 B2 5/2020 Brunty et al.
10,648,311 B2 5/2020 Oehring et al.
10,655,435 B2 * 5/2020 Oehring ..... E21B 43/26
10,669,471 B2 6/2020 Schmidt et al.
10,686,301 B2 6/2020 Oehring et al.
10,695,950 B2 6/2020 Igo et al.
10,711,576 B2 7/2020 Bishop
10,731,561 B2 8/2020 Oehring et al.
10,740,730 B2 8/2020 Altamirano et al.
10,753,165 B1 * 8/2020 Fischer ..... E21B 43/2607
10,767,561 B2 9/2020 Brady
10,781,752 B2 9/2020 Kikkawa et al.
10,794,165 B2 10/2020 Fischer et al.
10,988,998 B2 4/2021 Fischer et al.
2001/0000996 A1 5/2001 Grimland et al.
2003/0079875 A1 1/2003 Weng
2004/0045703 A1 3/2004 Hooper et al.
2005/0201197 A1 9/2005 Duell et al.
2006/0109141 A1 5/2006 Huang
2008/0095644 A1 4/2008 Mantei et al.
2008/0164023 A1 7/2008 Dykstra et al.
2008/0257449 A1 10/2008 Weinstein et al.
2008/0277120 A1 11/2008 Hickie
2009/0072645 A1 3/2009 Quere
2011/0052423 A1 * 3/2011 Gambier ..... F04B 49/065 417/63
2011/0081268 A1 4/2011 Ochoa et al.
2011/0110793 A1 5/2011 Leugemores et al.
2012/0063936 A1 3/2012 Baxter et al.
2012/0112757 A1 5/2012 Vrankovic et al.
2012/0150455 A1 6/2012 Franklin et al.
2012/0152716 A1 6/2012 Kikukawa et al.
2013/0051971 A1 2/2013 Wyse et al.
2013/0180722 A1 7/2013 Olarte Caro et al.
2013/0189629 A1 7/2013 Chandler
2013/0255271 A1 10/2013 Yu et al.
2013/0284455 A1 10/2013 Kajaria et al.
2013/0299167 A1 11/2013 Fordyce et al.
2014/0095114 A1 * 4/2014 Thomeer ..... G06Q 10/20 702/187
2014/0174717 A1 6/2014 Broussard et al.
2014/0277772 A1 * 9/2014 Lopez ..... E21B 43/26 700/282
2014/0290768 A1 * 10/2014 Randle ..... E21B 43/26 137/565.16
2014/0379300 A1 * 12/2014 Devine ..... F04B 51/00 702/182
2015/0147194 A1 5/2015 Foote
2015/0233530 A1 8/2015 Sandidge
2016/0006311 A1 1/2016 Li
2016/0032703 A1 * 2/2016 Broussard ..... E21B 43/26 166/250.01
2016/0102537 A1 * 4/2016 Lopez ..... E21B 43/26 700/282
2016/0208592 A1 * 7/2016 Oehring ..... F04D 29/669
2016/0230660 A1 8/2016 Zeitoun et al.
2016/0273456 A1 9/2016 Zhang et al.
2016/0290114 A1 * 10/2016 Oehring ..... E21B 43/26
2016/0326853 A1 11/2016 Fred et al.
2017/0022788 A1 * 1/2017 Oehring ..... F04B 49/103
2017/0028368 A1 * 2/2017 Oehring ..... B28C 9/04
2017/0030178 A1 * 2/2017 Oehring ..... E21B 43/26
2017/0037717 A1 * 2/2017 Oehring ..... F04B 53/003
2017/0043280 A1 2/2017 Vankouwenberg
2017/0074076 A1 3/2017 Joseph et al.
2017/0082033 A1 3/2017 Wu et al.
2017/0096885 A1 * 4/2017 Oehring ..... F04B 51/00
2017/0096889 A1 4/2017 Blanckaert et al.
2017/0138171 A1 5/2017 Richards et al.
2017/0159654 A1 6/2017 Kendrick
2017/0204852 A1 7/2017 Barnett
2017/0212535 A1 7/2017 Shelman et al.
2017/0226838 A1 8/2017 Ceizobka et al.
2017/0226842 A1 * 8/2017 Omont ..... E21B 44/005
2017/0292513 A1 * 10/2017 Haddad ..... G06F 30/20
2017/0370639 A1 12/2017 Barden et al.
2018/0038216 A1 * 2/2018 Zhang ..... E21B 43/26
2018/0090914 A1 3/2018 Johnson et al.
2018/0181830 A1 6/2018 Luharuka et al.
2018/0259080 A1 9/2018 Dale et al.
2018/0266217 A1 9/2018 Funkhauser et al.
2018/0284817 A1 10/2018 Cook et al.
2018/0298731 A1 10/2018 Bishop
2018/0312738 A1 11/2018 Rutsch et al.
2018/0313677 A1 11/2018 Warren et al.
2018/0320483 A1 * 11/2018 Zhang ..... G05B 13/021
2018/0363640 A1 12/2018 Kajita et al.
2018/0366950 A1 12/2018 Pedersen et al.
2019/0040727 A1 2/2019 Oehring et al.
2019/0112910 A1 * 4/2019 Oehring ..... E21B 41/0092
2019/0120024 A1 * 4/2019 Oehring ..... E21B 41/0092
2019/0128104 A1 5/2019 Graham et al.
2019/0145251 A1 5/2019 Johnson
2019/0154020 A1 5/2019 Glass
2019/0249527 A1 8/2019 Kraynek
2019/0257462 A1 8/2019 Rogers
2020/0040878 A1 2/2020 Morris
2020/0047141 A1 2/2020 Oehring et al.
2020/0088152 A1 3/2020 Allion et al.

(56) References Cited

U.S. PATENT DOCUMENTS

| | | | | |
|---|---|---|---|---|
| 2020/0141219 | A1* | 5/2020 | Oehring | E21B 21/062 |
| 2020/0325760 | A1 | 10/2020 | Markham | |
| 2020/0350790 | A1 | 11/2020 | Luft et al. | |

FOREIGN PATENT DOCUMENTS

| | | | |
|---|---|---|---|
| CN | 104196613 | A | 12/2014 |
| CN | 205986303 | U | 2/2017 |
| CN | 108049999 | A | 5/2018 |
| CN | 112196508 | A | 1/2021 |
| WO | 2009046280 | | 4/2009 |
| WO | 2014177346 | | 11/2014 |
| WO | 2018044307 | A1 | 3/2018 |
| WO | 2018213925 | A1 | 11/2018 |
| WO | 2019210417 | | 11/2019 |

OTHER PUBLICATIONS

Non-Final Office Action issued in U.S. Appl. No. 15/145,443 dated May 8, 2020.
Non-Final Office Action issued in U.S. Appl. No. 16/458,696 dated May 22, 2020.
International Search Report and Written Opinion issued in PCT/US2020/023809 dated Jun. 2, 2020.
Karin, "Duel Fuel Diesel Engines," (2015), Taylor & Francis, pp. 62-63, Retrieved from https://app.knovel.com/hotlink/toc/id:kpDFDE0001/dual-fueal-diesel-engines/duel-fuel-diesel-engines (Year 2015).
Goodwin, "High-voltage auxilliary switchgear for power stations," Power Engineering Journal, 1989, 10 pg. (Year 1989).
Non-Final Office dated Oct. 26, 2020 in U.S. Appl. No. 15/356,436.
Non-Final Office dated Oct. 5, 2020 in U.S. Appl. No. 16/443,273.
Non-Final Office Action dated Sep. 29, 2020 in U.S. Appl. No. 16/943,727.
Non-Final Office Action dated Sep. 2, 2020 in U.S. Appl. No. 16/356,263.
Non-Final Office Action dated Aug. 31, 2020 in U.S. Appl. No. 16/167,083.
Albone, "Mobile Compressor Stations for Natural Gas Transmission Service," ASME 67-GT-33, Turbo Expo, Power for Land, Sea and Air, vol. 79887, p. 1-10, 1967.
Canadian Office Action dated Sep. 22, 2020 in Canadian Application No. 2,982,974.
International Search Report and Written Opinion dated Sep. 3, 2020 in PCT/US2020/36932.
"Process Burner" (https://www.cebasrt.com/productsloii-gaslprocess-burner) 06 Sep. 6, 2018 (Sep. 6, 2018), entire document, especially para (Burners for refinery Heaters].
Water and Glycol Heating Systems• (https://www.heat-inc.com/wg-series-water-glycol-systems/) Jun. 18, 2018 (Jun. 18, 2018), entire document, especially WG Series Water Glycol Systems.
"Heat Exchanger" (https://en.wiklpedia.org/w/index.php?title=Heat_exchanger&oldid=89300146) Dec. 18, 2019 Apr. 2019 (Apr. 18, 2019), entire document, especially para (0001].
Canadian Office Action dated Sep. 8, 2020 in Canadian Patent Application No. 2,928,707.
Canadian Office Action dated Aug. 31, 2020 in Canadian Patent Application No. 2,944,980.
International Search Report and Written Opinion dated Aug. 28, 2020 in PCT/US20/23821.
Morris et al., U.S. Appl. No. 62/526,869; Hydration-Blender Transport and Electric Power Distribution for Fracturing Operation; Jun. 28, 2018; USPTO; see entire document.
Final Office Action dated Feb. 4, 2021 in U.S. Appl. No. 16/597,014.
International Search Report and Written Opinion dated Feb. 4, 2021 in PCT/US20/59834.
International Search Report and Written Opinion dated Feb. 2, 2021 in PCT/US20/58906.
International Search Report and Written Opinion dated Feb. 3, 2021 in PCT/US20/58899.
Non-Final Office Action dated Jan. 29, 2021 in U.S. Appl. No. 16/564,185.
Final Office Action dated Jan. 21, 2021 in U.S. Appl. No. 16/458,696.
Final Office Action dated Jan. 11, 2021 in U.S. Appl. No. 16/404,283.
Non-Final Office Action dated Jan. 4, 2021 in U.S. Appl. No. 16/522,043.
International Search Report and Written Opinion dated Dec. 14, 2020 in PCT/US2020/53980.
Kroposki et al., Making Microgrids Work, 6 IEEE Power and Energy Mag. 40, 41 (2008).
Dan T. Ton & Merrill A. Smith, The U.S. Department of Energy's Microgrid Initiative, 25 The Electricity J. 84 (2012), pp. 84-94.
Non-Final Office Action issued in U.S. Appl. No. 16/871,328 dated Dec. 9, 2021.
Non-Final Office Action issued in U.S. Appl. No. 16/943,935 dated Oct. 21, 2021.
Non-Final Office Action issued in U.S. Appl. No. 16/564,186, dated Oct. 15, 2021.
Final Office Action issued in U.S. Appl. No. 16/356,263 dated Oct. 7, 2021.
Non-Final Office Action issued in U.S. Appl. No. 17/060,647 dated Sep. 20, 2021.
Non-Final Office Action issued in U.S. Appl. No. 16/901,774 dated Sep. 14, 2021.
Canadian Office Action issued in Canadian Application No. 3,094,768 dated Oct. 28, 2021.
International Search Report and Written Opinion mailed in PCT/US20/67526 dated May 6, 2021.
International Search Report and Written Opinion mailed in PCT/US20/67608 dated Mar. 30, 2021.
International Search Report and Written Opinion mailed in PCT/US20/67528 dated Mar. 19, 2021.
International Search Report and Written Opinion mailed in PCT/US20/67146 dated Mar. 29, 2021.
International Search Report and Written Opinion mailed in PCT/US20/67523 dated Mar. 22, 2021.
International Search Report and Written Opinion mailed in PCT/US2020/066543 dated May 11, 2021.
Non-Final Office Action issued in U.S. Appl. No. 16/871,928 dated Aug. 25, 2021.
Non-Final Office Action issued in U.S. Appl. No. 16/943,727 dated Aug. 3, 2021.
Non-Final Office Action issued in U.S. Appl. No. 14/881,525 dated Jul. 21, 2021.
Non-Final Office Action issued in U.S. Appl. No. 16/404,283 dated Jul. 21, 2021.
Notice of Allowance and Notice of Allowability issued in U.S. Appl. No. 15/829,419 dated Jul. 26, 2021.
Woodbury et al., "Electrical Design Considerations for Drilling Rigs," IEEE Transactions on Industry Applications, vol. 1A-12, No. 4, Jul./Aug. 1976, pp. 421-431.

* cited by examiner

SMART FRACTURING SYSTEM AND METHOD

CROSS REFERENCE TO RELATED APPLICATIONS

This application is a continuation of U.S. patent application Ser. No. 16/170,695 filed Oct. 25, 2018 titled "SMART FRACTURING SYSTEM AND METHOD," now U.S. Pat. No. 10,655,435, issued May 19, 2020, and claims priority to and the benefit of U.S. Provisional Application Ser. No. 62/577,056 filed Oct. 25, 2017 titled "AUTOMATED FRACTURING PUMP SYSTEM" the full disclosure of which is hereby incorporated herein by reference in its entirety for all purposes.

BACKGROUND

With advancements in technology over the past few decades, the ability to reach unconventional sources of hydrocarbons has tremendously increased. Horizontal drilling and hydraulic fracturing are two such ways that new developments in technology have led to hydrocarbon production from previously unreachable shale formations. Hydraulic fracturing (fracturing) operations typically require powering numerous components in order to recover oil and gas resources from the ground. For example, hydraulic fracturing usually includes pumps that inject fracturing fluid down the wellbore, blenders that mix proppant into the fluid, cranes, wireline units, and many other components that all must perform different functions to carry out fracturing operations.

Conventionally, these components or systems of components are generally independent systems that are individually controlled by operators. Furthermore, in some cases, operators are also responsible for taking measurements, interpreting raw data, making calculations, and the like. Thus, a large amount of operator intervention to diagnose, interpret, respond to, adjust, and otherwise control operating conditions of the various components.

SUMMARY

Applicant recognized the problems noted above herein and conceived and developed embodiments of systems and methods, according to the present disclosure, for assessing flow rates in hydraulic fracturing systems.

In an embodiment, a hydraulic fracturing system includes a plurality of pumps positioned at a wellsite and configured to pressurize a fracturing fluid, a distribution system fluidly coupled to receive and consolidate fracturing fluid from the plurality of pumps for injection into a wellhead. The hydraulic fracturing system further includes a control system, which includes a plurality of sensing devices configured to measure one or more parameters of the plurality of pumps and the distribution system. The control system also includes one or more processing device configured to receive and analyze the one or more parameters measured by the plurality of sensing devices and generate control instructions based at least in part on the one or more parameters. The control system further includes one or more control device configured to receive the control instructions and control one or more aspects of the plurality of pumps or the distribution system based on the control instructions.

In an embodiment, a hydraulic fracturing method includes providing a fracturing fluid to a plurality of pumps, pumping the fracturing fluid into a distribution system, injecting the fracturing fluid into a well via a wellhead, and measuring one or more parameters of the plurality of pumps, the distribution system, or the wellhead via a plurality of sensing devices instrumented thereon. The method also includes generating automated instructions for one or more control devices based at least in part on the one or more parameters, and controlling one or more functions of the plurality of pumps, the distribution system, or the wellhead based at least in part on the automated instructions.

In an embodiment, a hydraulic fracturing method includes receiving a first data from a first sensing device of a pump system of a hydraulic fracturing system, the first data indicative of a condition of the pump system, and receiving second data from a second sensing device of a blender system of the hydraulic fracturing system, the blender system mixing together materials to form a fracturing fluid and delivering the fracturing fluid to the pump system, and the second data indicative of a condition of the blender system. The method also includes generating automated instructions for one or more control devices of the pump system or the blender system based at least in part on the first and second data, and controlling one or more functions of the plurality of the pump system or the blender system based at least in part on the automated instructions.

BRIEF DESCRIPTION OF DRAWINGS

The foregoing aspects, features, and advantage of embodiments of the present disclosure will further be appreciated when considered with reference to the following description of embodiments and accompanying drawings. In describing embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

DETAILED DESCRIPTION

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions. Additionally, recitations of steps of a method should be understood as being capable of being performed in any order unless specifically stated otherwise. Furthermore, the steps may be performed in series or in parallel unless specifically stated otherwise.

Figure 1:
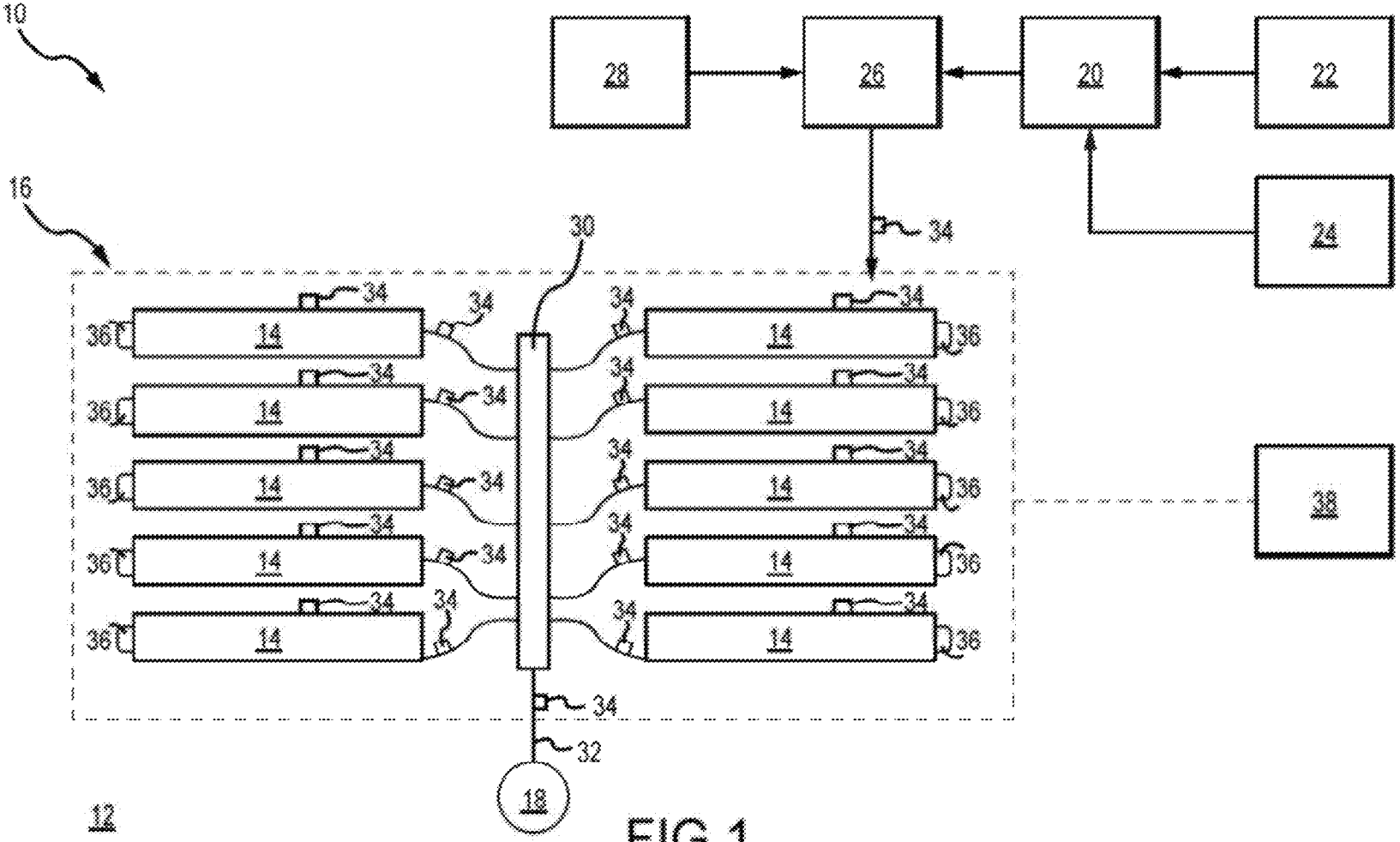
FIG. 1 is a schematic plan view of an embodiment of an automated hydraulic fracturing operation, in accordance with embodiments of the present disclosure.

FIG. 1 is a schematic representation of an embodiment of a hydraulic fracturing system 10 positioned at a well site 12. In the illustrated embodiment, pump trucks 14, which make up a pumping system 16, are used to pressurize a fracturing fluid solution for injection into a wellhead 18. A hydration unit 20 receives fluid from a fluid source 22 via a line, such as a tubular, and also receives additives from an additive source 24. In an embodiment, the fluid is water and the additives are mixed together and transferred to a blender unit 26 where proppant from a proppant source 28 may be added to form the fracturing fluid solution (e.g., fracturing fluid) which is transferred to the pumping system 16. The pump trucks 14 may receive the fracturing fluid solution at a first pressure (e.g., 80 psi to 100 psi) and boost the pressure to around 15,000 psi for injection into the wellhead 18. In certain embodiments, the pump trucks 14 are powered by electric motors.

After being discharged from the pump system 16, a distribution system 30, such as a missile, receives the fracturing fluid solution for injection into the wellhead 18. The distribution system 30 consolidates the fracturing fluid solution from each of the pump trucks 14 (for example, via common manifold for distribution of fluid to the pumps) and includes discharge piping 32 (which may be a series of discharge lines or a single discharge line) coupled to the wellhead 18. In this manner, pressurized solution for hydraulic fracturing may be injected into the wellhead 18. In the illustrated embodiment, one or more sensors 34, 36 are arranged throughout the hydraulic fracturing system 10. In embodiments, the sensors 34 transmit flow data to a data van 38 for collection and analysis, among other things.

Figure 2:
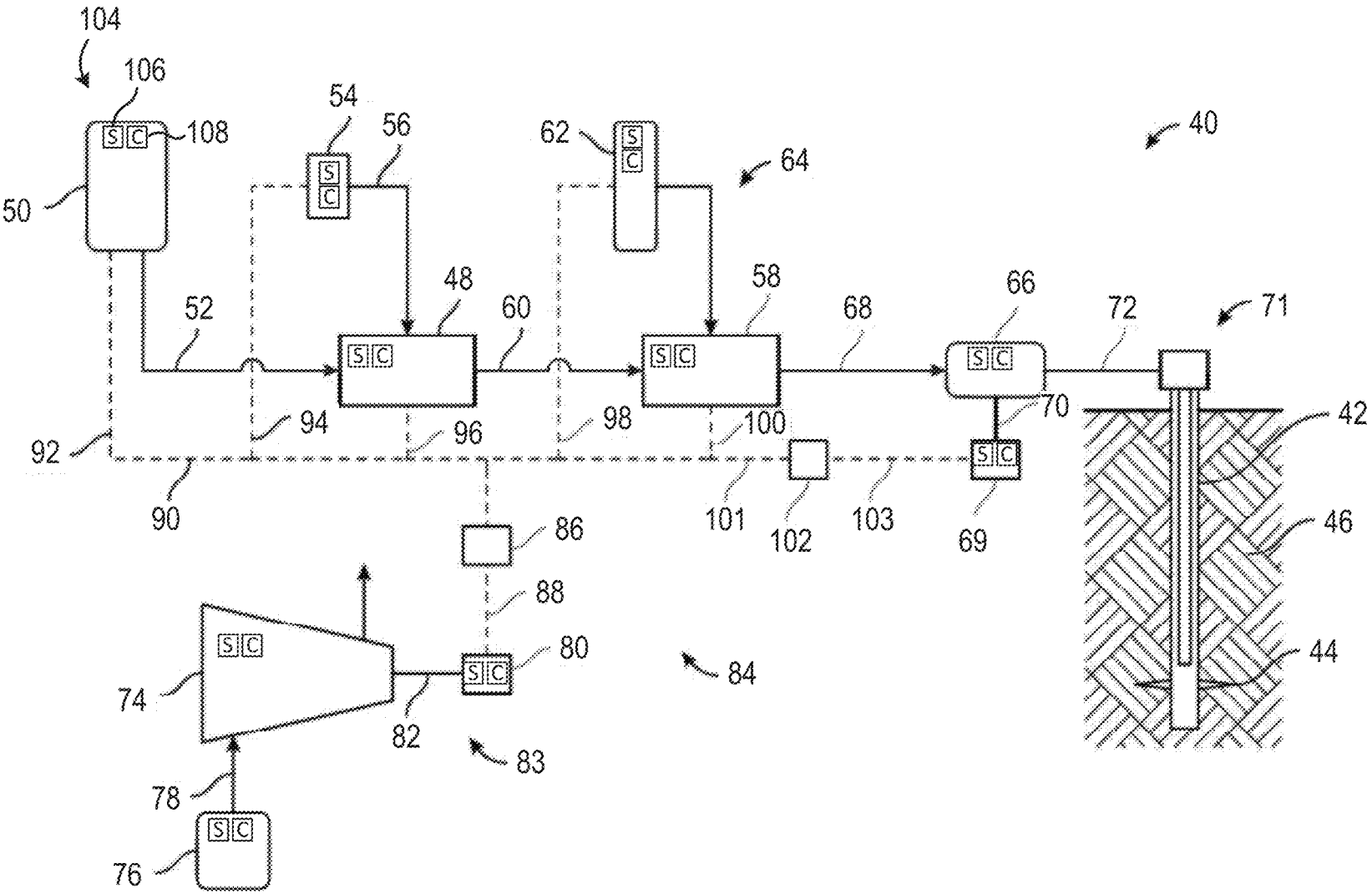
FIG. 2 is a schematic diagram of an embodiment of an automated hydraulic fracturing system, in accordance with embodiments of the present disclosure.

FIG. 2 is a detailed schematic representation of an automated hydraulic fracturing system 40, that can be used for pressurizing a wellbore 42 to create fractures 44 in a subterranean formation 46 that surrounds the wellbore 42. Included with the system 40 is a hydration unit 48 that receives fluid from a fluid source 50 via line 52, and also selectively receives additives from an additive source 54 via line 56. Additive source 54 can be separate from the hydration unit 48 as a stand-alone unit, or can be included as part of the same unit as the hydration unit 48. The fluid, which in one example is water, is mixed inside of the hydration unit 48 with the additives. In an embodiment, the fluid and additives are mixed over a period of time, to allow for uniform distribution of the additives within the fluid. In the example of FIG. 2, the fluid and additive mixture is transferred to a blender unit 58 via line 60. A proppant source 62 contains proppant, which is delivered to the blender unit 58 as represented by line 64, where line 64 can be a conveyer. Inside the blender unit 58, the proppant and fluid/additive mixture are combined to form a fracturing fluid, which is then transferred to a fracturing pump system 66 via line 68; thus fluid in line 68 includes the discharge of blender unit 58 which is the suction (or boost) for the fracturing pump system 66.

Blender unit 58 can have an onboard chemical additive system, such as with chemical pumps and augers. Optionally, additive source 54 can provide chemicals to blender unit 58; or a separate and standalone chemical additive system (not shown) can be provided for delivering chemicals to the blender unit 58. In an example, the pressure of the fracturing fluid in line 68 ranges from around 80 psi to around 100 psi. The pressure of the fracturing fluid can be increased up to around 15,000 psi by pump system 66. A motor 69, which connects to pump system 66 via connection 70, drives pump system 66 so that it can pressurize the fracturing fluid. In one example, the motor 69 is controlled by a variable frequency drive ("VFD").

After being discharged from pump system 66, fracturing fluid is pumped into a wellhead assembly 71. Discharge piping 42 connects discharge of pump system 66 with wellhead assembly 71 and provides a conduit for the fracturing fluid between the pump system 66 and the wellhead assembly 71. In an alternative, hoses or other connections can be used to provide a conduit for the fracturing fluid between the pump system 66 and the wellhead assembly 71. Optionally, any type of fluid can be pressurized by the fracturing pump system 66 to form injection fracturing fluid that is then pumped into the wellbore 42 for fracturing the formation 44, and is not limited to fluids having chemicals or proppant.

An example of a turbine 74 is provided in the example of FIG. 1. The turbine 74 can be gas powered, receiving a combustible fuel from a fuel source 76 via a feed line 78. In one example, the combustible fuel is natural gas, and the fuel source 76 can be a container of natural gas or a well (not shown) proximate the turbine 74. Combustion of the fuel in the turbine 74 in turn powers a generator 80 that produces electricity. Shaft 82 connects generator 80 to turbine 74. The combination of the turbine 74, generator 80, and shaft 82 define a turbine generator 83. In another example, gearing can also be used to connect the turbine 74 and generator 80.

An example of a micro-grid 84 is further illustrated in FIG. 2, and which distributes electricity generated by the turbine generator 83. Included with the micro-grid 84 is a transformer 86 for stepping down voltage of the electricity generated by the generator 80 to a voltage more compatible for use by electrically powered devices in the hydraulic fracturing system 40. In another example, the power generated by the turbine generator and the power utilized by the electrically powered devices in the hydraulic fracturing system 10 are of the same voltage, such as 4160 V, so that main power transformers are not needed. In one embodiment, multiple 3500 kVA dry cast coil transformers are utilized. Electricity generated in generator 80 is conveyed to transformer 86 via line 88. In one example, transformer 86 steps the voltage down from 13.8 kV to around 600 V. Other step down voltages can include 4,160 V, 480 V, or other voltages.

The output or low voltage side of the transformer 56 connects to a power bus 90, lines 92, 94, 96, 98, 100, and 101 connect to power bus 90 and deliver electricity to electrically powered components of the system 40. More specifically, line 92 connects fluid source 20 to bus 90, line 94 connects additive source 24 to bus 90, line 96 connects hydration unit 18 to bus 90, line 98 connects proppant source 62 to bus 90, line 100 connects blender unit 28 to bus 90, and line 101 connects bus 90 to an optional variable frequency drive ("VFD") 102. Line 103 connects VFD 102 to motor 69. In one example, VFD 102 can be used to control operation of motor 69, and thus also operation of pump 66.

In an example, additive source 54 contains ten or more chemical pumps for supplementing the existing chemical pumps on the hydration unit 48 and blender unit 58. Chemicals from the additive source 54 can be delivered via lines 56 to either the hydration unit 48 and/or the blender unit 58. In one embodiment, the elements of the system 40 are mobile and can be readily transported to a wellsite adjacent the wellbore 42, such as on trailers or other platforms equipped with wheels or tracks.

In the illustrated embodiment, one or more instrumentation devices 104 such as various types of sensors 106 and controllers 108 are arranged throughout the hydraulic fracturing system 40 and coupled to one or more of the aforementioned components, including any of the wellhead assembly 71, pump 66, blender unit 58, proppant source 62, hydration unit 48, additive source 54, fluid source 50, generator 80, turbine 74, fuel source 76, any deliveries lines, and various other equipment used in the hydraulic fracturing system 40, not all of which are explicitly described herein for sake of brevity. The instrumentation 104 may include various sensors, actuators, and/or controllers, which may be different for different components. For example, the instrumentation devices 104 may include hardware features such as, low pressure transducer (low and high frequency), high pressure transducers (low and high frequency), low frequency accelerometers, high frequency accelerometers, temperature sensors, external mounted flow meters such as doppler and sonar sensors, magnetic flow meters, turbine flow meters, proximity probes and sensors, speed sensors, tachometers, capacitive, doppler, inductive, optical, radar, ultrasonic, fiber optic, and hall effect sensors, transmitters and receivers, stroke counters, GPS location monitoring, fuel consumption, load cells, PLCs, and timers. In some embodiments, the instrumentation devices may be installed on the components and dispersed in various locations.

The components may also include communication means that enable all the sensor packages, actuation devices, and equipment components to communicate with each other allowing for real time conditional monitoring. This would allow equipment to adjust rates, pressure, operating conditions such as engine, transmission, power ends RPMs, sand storage compartment gates, valves, and actuators, sand delivery belts and shoots, water storage compartments gates, valves, and actuators, water delivery lines and hoses, individual fracture pump's rates as well as collective system rates, blender hydraulics such as chemical pumps, liquid and dry, fan motors for cooling packages, blender discharge pumps, electric and variable frequency powered chemical pumps and auger screws, suction and discharge manifold meters, valves, and actuators. Equipment can prevent failures, reduce continual damage, and control when it is allowed and not allowed to continue to operate based on live and continuous data readings. Each component may be able to provide troubleshooting codes and alerts that more specifically narrow down the potential causes of issues. This allows technicians to more effectively service equipment, or for troubleshooting or other processes to be initialized automatically. Conditional monitoring will identify changes in system components and will be able to direct, divert, and manage all components so that each is performing its job the most efficiently In some embodiments, the sensors may transmit data to a data van 38 for collection and analysis, among other things. In some embodiment, the sensors may transmit data to other components, to the central processing unit, or to devices and control units remote from the site. The communications between components, sensors, and control devices may be wired, wireless, or a combination of both. Communication means may include fiber optics, electrical cables, WiFi, Bluetooth, radio frequency, and other cellular, nearfield, Internet-based, or other networked communication means.

The features of the present disclosure may allow for remote monitoring and control from diverse location, not solely the data van 68. Fracturing control may be integrated in with the sensor and monitoring packages 104 to allow for automated action to be taken when/if needed. Equipment may be able to determine issues or failures on its own, then relay that message with a specified code and alarm. Equipment may also be in control to shut itself down to prevent failures from occurring. Equipment may monitor itself as well as communicate with the system as a whole. This may allow whole system to control equipment and processes so that each and every component is running at its highest efficiency, sand, water, chemical, blenders, pumps, and low and high pressure flow lines. Features of the present disclosure may capture, display, and store data, which may be visible locally and remotely. The data may be accessible live during the data collection and historical data may also be available. Each component to this system can be tested individually with simulation as well as physical function testing.

Operating efficiencies for each individual component and the system 40 may be greatly improved. For example, sand storage and delivery to the blender can be monitored with load cells, sonar sensors and tachometers to determine storage amounts, hopper levels, auger delivery to the tub. Pump efficiencies may be monitored with flow sensors, accelerometers, pressure transducer and tachometers to optimize boost and rate while minimizing harmful conditions such as cavitation or over rating. Failure modes such as wash outs, cutting, valve and/or seat failures, packing issues and supply blockage can be captured and then prevented. Flow lines, both suction supply and discharge can be monitored with flow meters to distribute and optimize flow rates and velocities while preventing over pumping scenarios. Feedback loops of readings from blender to supply manifolds and to pumps can work with each other to optimize pressure and flow. Dropping out of an individual pump may occur preventing further failures, when this occurs the system as a whole may automatically select the best pumps to make up that needed rate. These changes and abilities solve equipment issues and prevent down time as well as provide a means to deliver a consistent job.

In some embodiments, instrumentation devices 104 (any of the above described, among others) can be imbedded, mounted, located in various locations such as in line with flow vessels like hoses, piping, manifolds, placed one pump components such as fluid ends, power ends, transmission, engines, and any component within these individual pieces, mounted external to piping and flow vessels, mounted on under or above sand and water storage containers. Blender hoppers could be duel equipped with hopper proximity level sensors as well as a load cell to determine amount of sand in the hopper at any given time.

Figure 3:
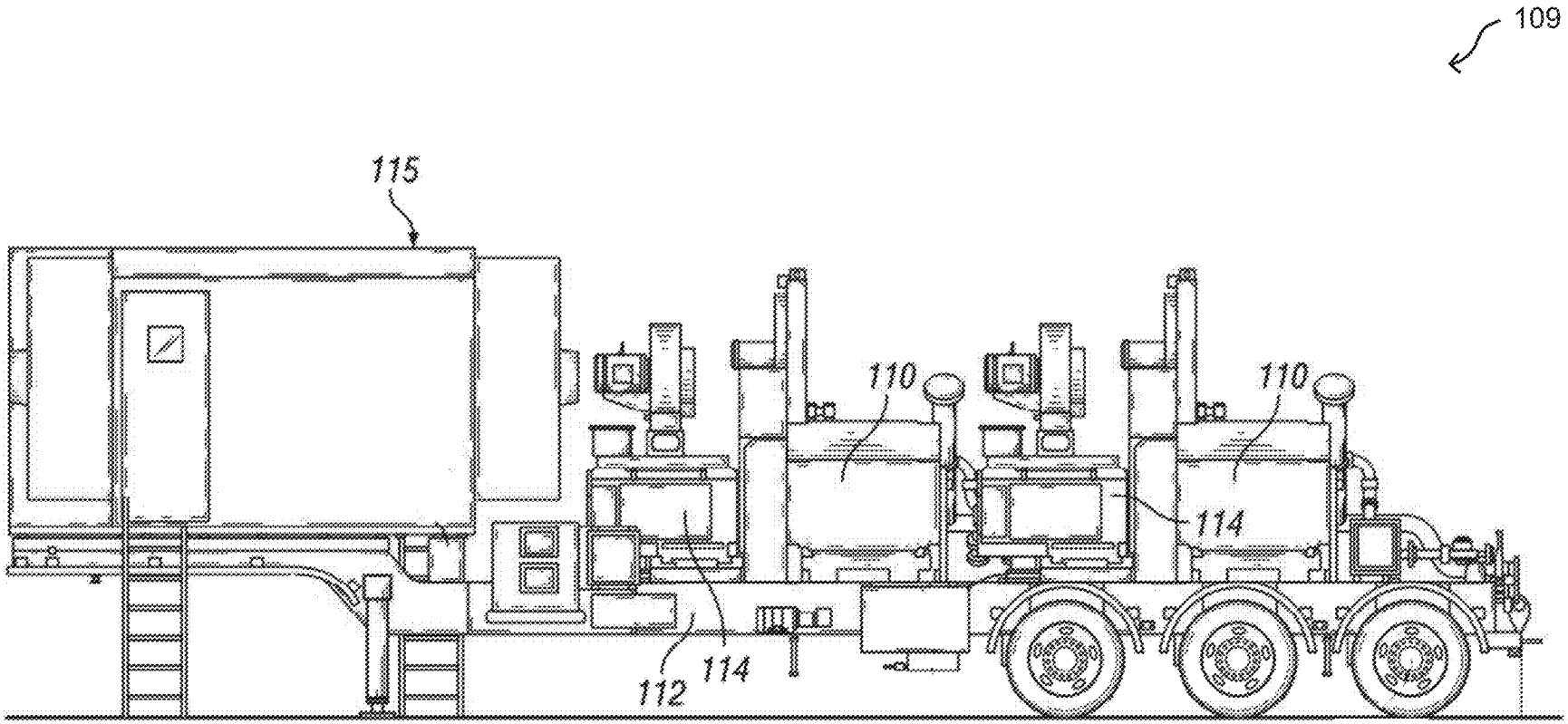
FIG. 3 illustrates an instrumented fracturing pump system, in accordance with embodiments of the present disclosure.

FIG. 3 illustrates an example fracturing pump system 109, in accordance with example embodiments. As illustrated, the fracturing pump system 109 includes instrumented components, including motors 114, a variable frequency drive (VFD) 115, pumps 110, a power end, and a fluid end. The fluid end may further include instrumented components such as packings, valves, seats, stay rod bolts, suction manifold, suction hoses, and discharge flow iron.

These components may include embedded or retrofitted hardware devices which are configured to sense various conditions and states associated with the components. Example hardware devices include low pressure transducer (low and high frequency), high pressure transducers (low and high frequency), low frequency accelerometers, high frequency accelerometers, temperature sensors, external mounted flow meters such as doppler and sonar sensors, magnetic flow meters, turbine flow meters, proximity probes and sensors, speed sensors, tachometers, capacitive, doppler, inductive, optical, radar, ultrasonic, fiber optic, and hall effect sensors, transmitters and receivers, stroke counters, gps location monitoring, fuel consumption, PLCs, and timers. The system may be attached to a trailer 112 or a skid.

The fracturing pump components may also include various types of communications devices such as transmitters, receivers, or transceivers, using various communication protocols. This enables components of the fracturing pump components to communicate amongst each other or with a central control unit or remote device to monitor conditions, ensuring that the pumping process is completed effectively and consistently. Communication between the equipment can be both wired and/or wireless, such as through Ethernet, WiFi, Bluetooth, cellular, among other options. Data captured by the hardware can be displayed live locally, stored locally, displayed live remotely, or stored remotely. Such data may be accessed in real-time as well as stored and retrieved at a later time as historical data. In some embodiments, data from one component can be used to determine real time actions to be taken by another component to ensure proper functionality of each component. Specifically, this may allow equipment to adjust rates, pressure, operating conditions such as engine, transmission, power end rotations per minute (RPMs), valves, actuators, individual fracturing pump rates as well as collective system rates, fan motors for cooling packages, electric and variable frequency drive (VFD) powered electric motors for pumps, suction and discharge manifold meters, valves, and actuators. Equipment can prevent failures, reduce continual damage, and control operation based on live and continuous data readings.

Additionally, each component may be able to provide troubleshooting codes and alerts that more specifically provides information regarding the potential causes of issues or current conditions. This information may allow technicians to more effectively service equipment. Conditional monitoring can be used to identify changes in system components and can direct, divert, and manage all components such that each component performs its function with optimal efficiency and/or effectiveness. Failures may be reduced because of the ability to automatically shut down equipment based on continuous real-time readings from various sensors. The components can monitor themselves as well as communicate with the system as a whole.

Present systems and techniques may improve the operating efficiencies for each individual component and the system as a whole. For example, pump efficiencies can be monitored with flow sensors, accelerometers, pressure transducer and tachometers to optimize boost and rate while minimizing harmful conditions such as cavitation or over rating. Failure modes such as wash outs, cutting, valve failures, seat failures, packing issues and supply blockage, can be captured and then prevented. Flow lines, both suction supply and discharge can be monitored with flow meters to distribute and optimize flow rates and velocities while preventing over pumping scenarios. In some embodiments, feedback loops of readings from blender to supply manifolds and to pumps can work with each other to optimize pressure and flow.

In various embodiments, for example, an individual pump may be dropped from operation to prevent further failures. When this occurs, the system as a whole may automatically select the best pump(s) to make up for the dropped pump. Power ends (pumps) may keep track of stroke counts and pumping hours. This data may be accompanied with maintenance logs which may help determine schedules and maintenance procedures. In some embodiments, transmissions may be monitored for each individual gear, duration and load may be logged as well as temperature. If any of these various components were to indicate an alarm that would be detrimental to the equipment, the signal from that sensor may relay the message to shut the entire pump down.

Figure 4:
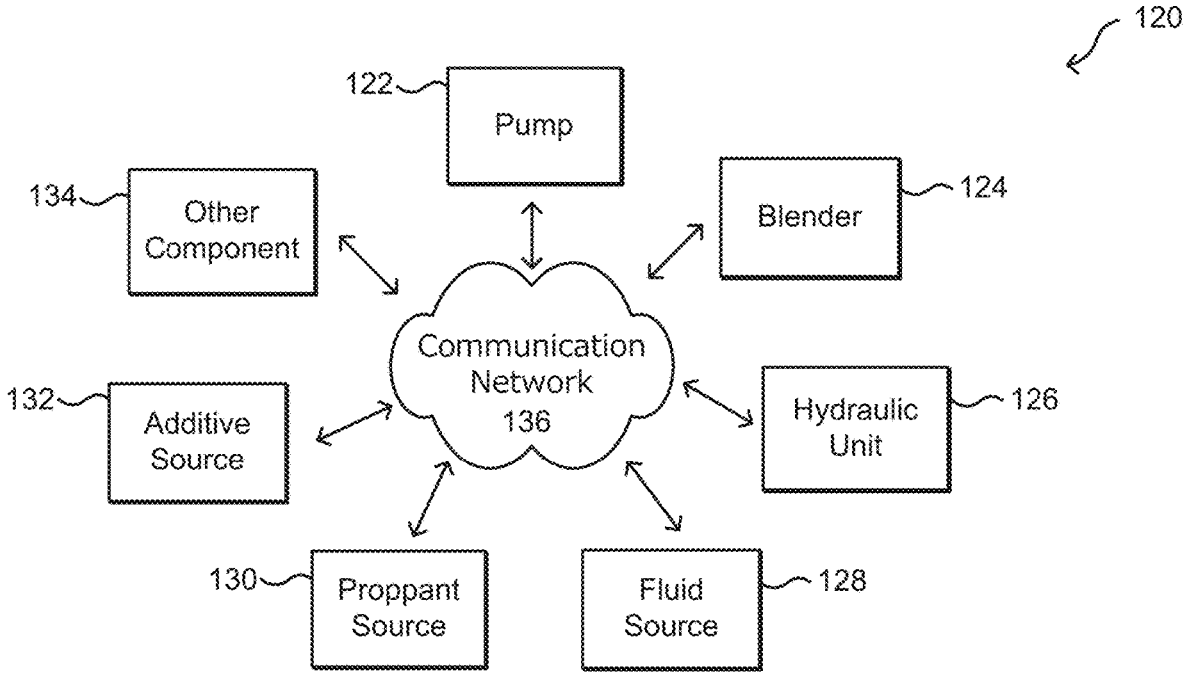
FIG. 4 is a diagram of communicative components of an automated hydraulic fracturing system, in accordance with embodiments of the present disclosure.

FIG. 4 includes a diagram 120 illustrating a connected automated fracturing system, in accordance with various embodiments. In this example, one or more components 42 of a fracturing system, such as a pump 122, blender 124, hydration unit 126, fluid source 128, proppant source 130, additive source 132, and one or more other components 134, may include communication devices for transmitting and receiving data with each other over a communication network 136. In some embodiments, at least some of the components include processors that analyze the data received from one or more of the other components and automatically controls one or more aspects of that component. The communication network 136 may include various types of wired or wireless communication protocols, or a combination of wired and wireless communications. In some embodiments, the connected automated fracturing system further includes one or more of a plurality of components including a manifold, a manifold trailer, a discharge piping, flow lines, conveyance devices, a turbine, a motor, a variable frequency drive, a generator, or a fuel source. Sensors and control devices may be integrated into the one or more of these components, allowing these components to communicate with the rest of the system.

Figure 5:
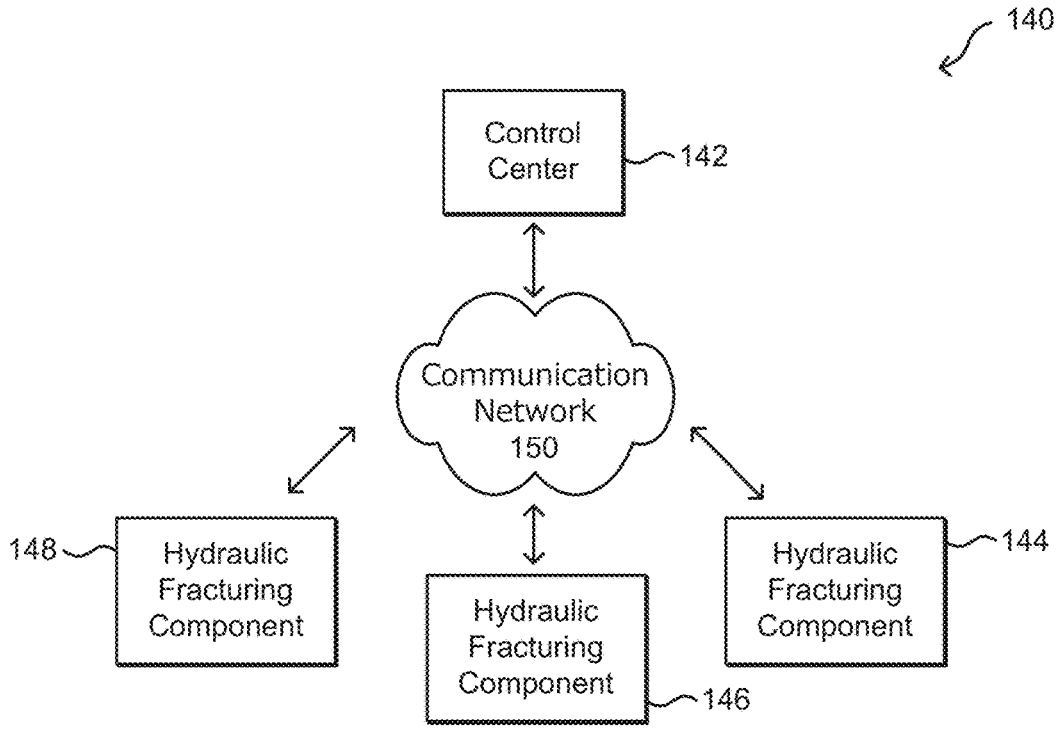
FIG. 5 is a diagram of communicative components of an automated hydraulic fracturing system with a central control center, in accordance with embodiments of the present disclosure.

FIG. 5 includes a diagram 140 illustrating a communications network of the automated fracturing system, in accordance with various embodiments. In this example, one or more hydraulic fracturing components 148, such as, and not limited to, any of those mentioned above, may be communicative with each other via a communication network 150 such as described above with respect to FIG. 4. The components 148 may also be communicative with a control center 142 over the communication network 150. The control center 142 may be instrumented into the hydraulic fracturing system or a component. The control center 142 may be onsite, in a data van, or located remotely. The control center 142 may receive data from any of the components 148, analyze the received data, and generate control instructions for one or more of the components based at least in part on the data. For example, the control center 142 may control an aspect of one component based on a condition of another component. In some embodiments, the control center 142 may also include a user interface, including a display for displaying data and conditions of the hydraulic fracturing system. The user interface may also enable an operator to input control instructions for the components 144. The control center 142 may also transmit data to other locations and generate alerts and notification at the control center 150 or to be received at user device remote from the control center 142.

In some embodiments, a hydraulic fracturing system includes a plurality of pumps positioned at a wellsite and configured to pressurize a fracturing fluid, a distribution system fluidly coupled to receive and consolidate fracturing fluid from the plurality of pumps for injection into a wellhead. The hydraulic fracturing system further includes a control system, which includes a plurality of sensing devices configured to measure one or more parameters of the plurality of pumps and the distribution system. The control system also includes one or more processing device configured to receive and analyze the one or more parameters measured by the plurality of sensing devices and generate control instructions based at least in part on the one or more parameters. The control system further includes one or more control device configured to receive the control instructions and control one or more aspects of the plurality of pumps or the distribution system based on the control instructions.

In some embodiments, the one or more sensing device are installed on the plurality of pumps and the distribution system, and include at least one of flow sensors, accelerometers, pressure transducer, or tachometers. The plurality of pumps or the distribution system may include at least one of a gate, valve, actuator, motor, suction pipe, discharge pipe, engine, transmission, or temperature regulation device, controllable via the one or more control device. In some embodiments, the system further includes a suction line through which fracturing fluid is supplied and a discharge line through which fracturing fluid is discharged, and the plurality of sensing devices includes one or more flow sensors configured to measure flow through the suction line and the discharge line.

The system may also include one or more blenders configured to mix together one or more materials to form the fracturing fluid, wherein the fracturing fluid is provided from the blender to the plurality of pumps via a manifold, wherein the plurality of sensing devices includes one or more pressure or flow sensors for measuring flow and/or pressure conditions at the one or more blenders, the manifold, the plurality of pumps and the distribution system. In some embodiments, the one or more control device is configured to control the one or more blenders, the manifold, the plurality of pumps and the distribution system based on the flow and/or pressure conditions.

Figure 6:
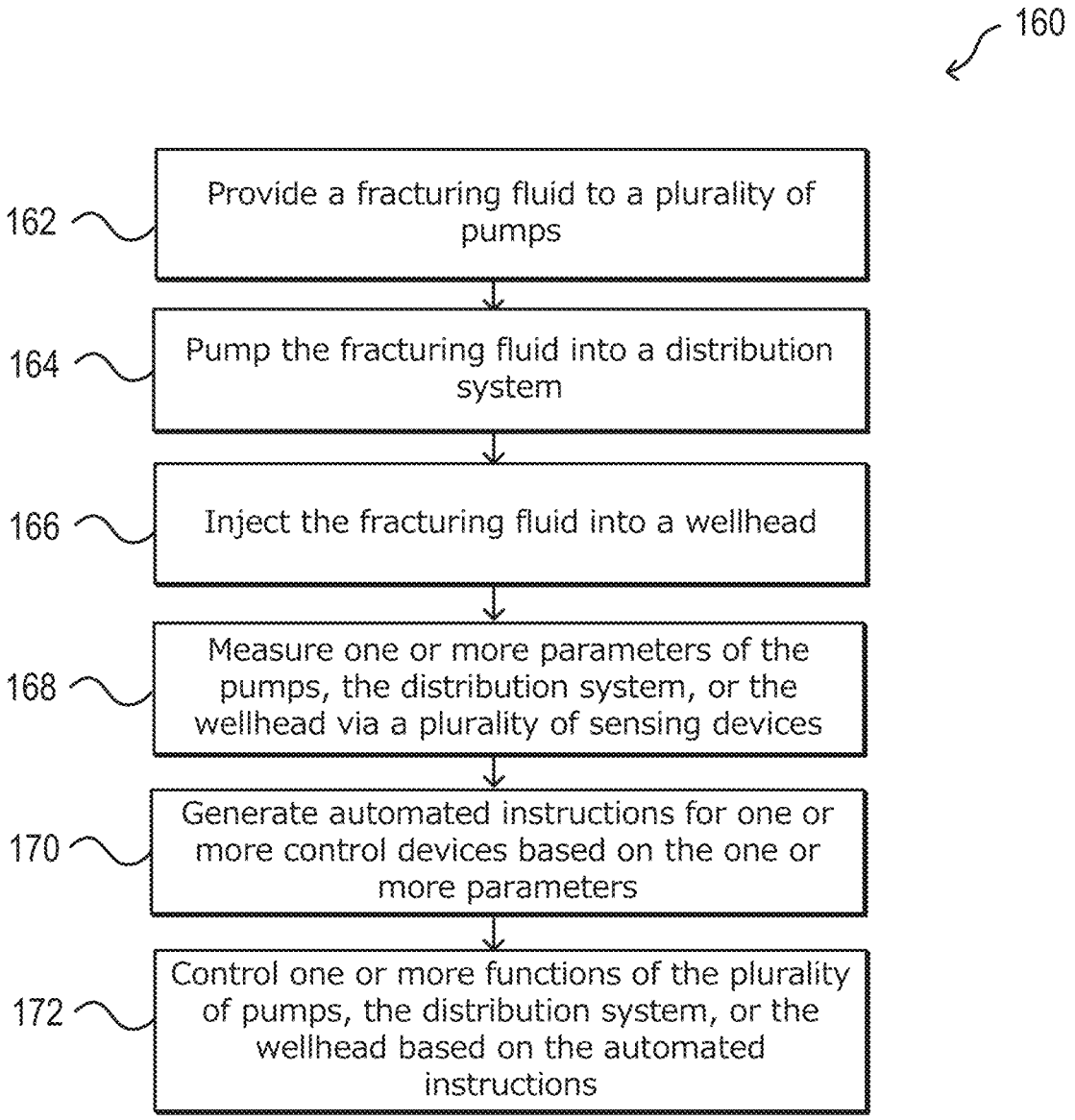
FIG. 6 is a flow chart of an embodiment of an automated hydraulic fracturing method, in accordance with embodiments of the present disclosure.

FIG. 6 is a flow chart of an embodiment of an automated hydraulic fracturing method 160, in accordance with example embodiments. It should be noted that the method may include additional steps, fewer steps, and differently ordered steps than illustrated in this example. In this example, a fracturing fluid is provided 162 to a plurality of pumps, and the fracturing fluid is pumped 164 into a distribution system. The fracturing fluid is then injected 166 into a well via a wellhead. One or more parameters of the plurality of pumps, the distribution system, or the wellhead is measured 168 via a plurality of sensing devices instrumented thereon. Automated instructions are then generated for one or more control devices based at least in part on the one or more parameters, and one or more functions of the plurality of pumps, the distribution system, or the wellhead can be controlled based at least in part on the automated instructions.

In some embodiments, the method 160 also includes detecting that a first parameter of the one or more parameters is outside of an acceptable threshold, in which the first parameter is associated with a first pump of the plurality of pumps, and automatically adjusting or turning off the first pump. In some embodiments, the method 160 also includes adjusting one or more of the other pumps in the plurality of pumps to compensate for the first pump. In some embodiments, the method 160 also includes selecting the one or more of the other pumps to adjust based at least in part on the conditions of the other pumps as indicated by one or more of the one or more parameters. In one or more embodiments, the method 160 also includes determining that the one or more parameters are indicative of a potential failure condition; and determining a source of the potential failure condition. In some embodiments, the method 160 also includes generating an alert or notification indicative of the potential failure condition and the source. In some embodiments, the method 160 also includes logging operation data including a number of strokes and pumping hours performed by a pump of the plurality of pumps, and determining a maintenance schedule based at least in part on the operation data.

The hydraulic fracturing system may include other components, such as a turbine, a generator, a hydration unit, a distribution system, a fuel source, or a wellhead, among others. These components may also be instrumented with sensors that measures at least one parameter associated with the turbine, the generator, the hydration unit, the distribution system, the fuel source, or the wellhead. These components may also include controllers, which control at least one aspect of the turbine, the generator, the hydration unit, the distribution system, the fuel source, or the wellhead, based at least in part on the automated instructions. In some embodiments, the hydraulic fracturing system includes a plurality of pumps and a distribution system, in which fracturing fluid is provided from the blender to the plurality of pumps, the fracturing fluid is provided from the plurality of pumps to the distribution system, and the fracturing fluid is injected from the distribution system into the wellbore. The individual pressure at each pump may be automatically adjusted based on the automated instructions. The combined or overall pump rate of the plurality of pumps may also be controlled, and the rate at the distribution system may also be controlled via the automated instructions.

Figure 7:
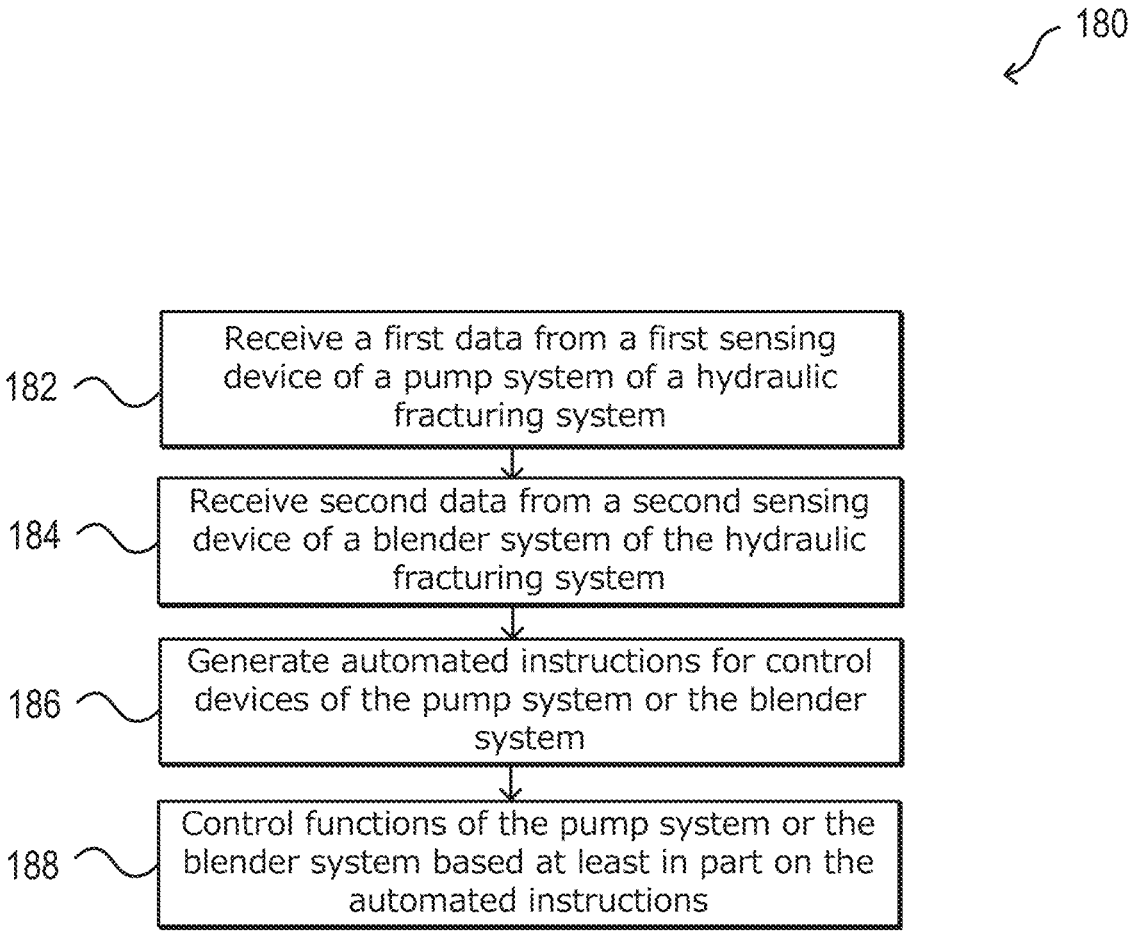
FIG. 7 is a flow chart of an embodiment of a method of controlling an automated hydraulic fracturing system, in accordance with embodiments of the present disclosure.

FIG. 7 illustrates a method 180 of controlling an automated fracturing system, in accordance with various embodiments. In this embodiment, a first data is received 182 from a first sensing device of a pump system of a hydraulic fracturing system. The first data may be indicative of a condition of the pump system, such as a flow rate, pump efficiency, temperature, pressure, among others. Second data may be received 184 from a second sensing device of a blender system of the hydraulic fracturing system. The blender system mixes together materials such as proppant and a fluid to form a fracturing fluid and delivers the fracturing fluid to the pump system. The second data may be indicative of a condition of the blender system. Automated instructions for one or more control devices of the pump system or the blender system is generated based at least in part on the first and second data. one or more functions of the plurality of the pump system or the blender system is controlled based at least in part on the automated instructions.

In some embodiments, the pump system includes one or more pumps and a distribution system that receives and consolidates the fracturing fluid from the one or more pumps for injection into a wellhead. In some embodiments, the method 180 also includes controlling one or more functions of the distribution system based on the automated instructions. In some embodiments, the pump system includes a plurality of pumps, and the first data includes measurements of each of the plurality of pumps. The method 180 may also include controlling one or more of the plurality of pumps individually based on the automated instructions. The method 180 may further include detecting that a measurement associated with a first pump of the plurality of pumps is outside of an acceptable threshold, and automatically taking the first pump offline in response to the detection. The method may further include adjusting one or more of the other pumps in the plurality of pumps to compensate for taking the first pump offline.

Figure 8:
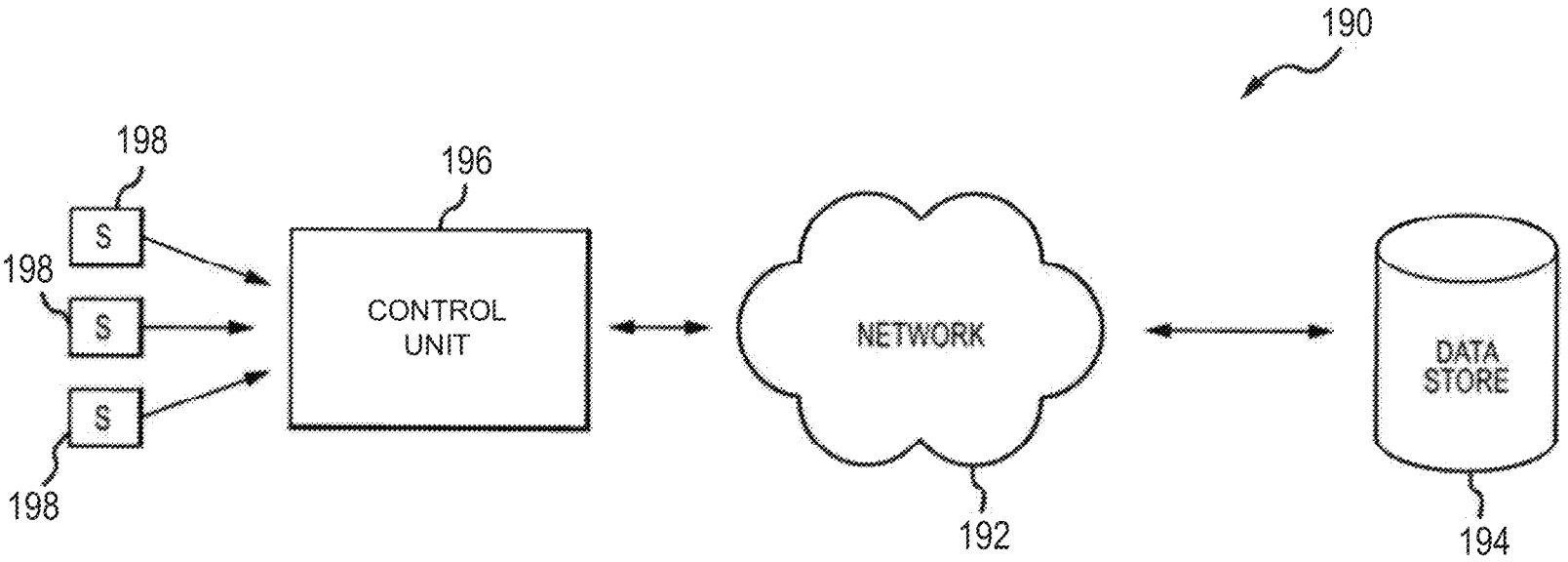
FIG. 8 is a block diagram of an embodiment of a control system of an automated hydraulic fracturing system, in accordance with embodiments of the present disclosure.

FIG. 8 is a block diagram of an embodiment of a control system 190 for receiving, analyzing, and storing information from the well site. As described above, sensors 198 are arranged at the well site and may transmit data to a control unit 196 for evaluation and potential adjustments to operating parameters of equipment at the well site. The control unit 196 may be communicatively coupled to a network 192, such as the Internet, that can access a data store 194, such as a cloud storage server. Accordingly, in embodiments, data from the sensors 198 is transmitted to the control unit 196 (which may be located on a component, within a data van, or remotely) and is stored locally. However, the control unit 196 may upload the data from the sensors 198 along with other data, to the data store 194 via the network 192. Accordingly, data from previous pumping operations or different sensors may be utilized to adjust various aspects of the hydraulic fracturing operation as needed. For example, the flow data from the sensor 198 may be coupled with information from the sensors 198 (such as the vibration sensor, gear sensors, RPM sensors, pressure sensors, etc.) to provide diagnostics with information from the data store 194. For example, previous data may be used as training data for a machine learning model for predicting various control parameters of a present operation.

In embodiments, the data store 194 includes information of the equipment used at the well site. It should be appreciated that, in various embodiments, information from the data store 194 may be stored in local storage, for example in storage within a data can, and as a result, communication over the network 192 to the remote data store 194 may not be used. For example, in various embodiments, drilling operations may be conducted at remote locations where Internet data transmission may be slow or unreliable. As a result, information from the data store 194 may be downloaded and stored locally at the data van before the operation, thereby providing access to the information for evaluation of operation conditions at the well site.

The foregoing disclosure and description of the disclosed embodiments is illustrative and explanatory of the embodiments of the invention. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A hydraulic fracturing system, comprising:

one or more pumps;

a distribution system; and a control system comprising:

a plurality of sensing devices configured to measure one or more parameters of the one or more pumps and the distribution system;

one or more processing devices configured to receive a first parameter from a first device of the one or more pumps or the distribution system, and transmit the first parameter to a second device of the one or more pumps or the distribution system, and detect that the first parameter is outside of an acceptable threshold, and generate automated control instructions at the second device based at least in part on the first parameter; and one or more control devices configured to receive the automated control instructions and automatically adjust one or more aspects of the second device based on the control instructions.

2. The system of claim 1, further comprising:

a suction line through which fracturing fluid is supplied, wherein the plurality of sensing devices includes one or more flow sensors configured to measure flow through the suction line.

3. The system of claim 2, further comprising:

a discharge line through which fracturing fluid is discharged, wherein the plurality of sensing devices includes one or more flow sensors configured to measure flow through the discharge line.

4. The system of claim 1, further comprising:

one or more blenders, wherein the plurality of sensing devices includes one or more pressure or flow sensors for measuring flow conditions at the one or more blenders.

5. The system of claim 1, wherein the plurality of sensing devices are installed on the one or more pumps and the distribution system, and selected from a group including flow sensors, accelerometers, pressure transducer, and tachometers.

6. The system of claim 1, wherein the one or more pumps or the distribution system includes at least one device selected from a group include a gate, valve, actuator, motor, suction pipe, discharge pipe, engine, transmission, and temperature regulation device, controllable via the one or more control devices.

7. A hydraulic fracturing method, comprising:

measuring one or more parameters of a plurality of components of a hydraulic fracturing system;

detecting that a first parameter of the one or more parameters is outside of an acceptable threshold;

generating automated instructions for one or more control devices based at least in part on the first parameter;

automatically adjusting one or more functions of the hydraulic fracturing system based at least in part on the automated instructions;

transmitting the first parameter from a first component of the hydraulic fracturing system to a second component of the hydraulic fracturing system;

generating the automated instructions at the second component based at least in part on the first parameter; and automatically adjusting one or more functions of the second component based on the automated instructions.

8. The method of claim 7, further comprising:

detecting that a first pump of a plurality of pumps is underperforming, wherein the plurality of components includes the plurality of pumps.

9. The method of claim 8, further comprising:

adjusting one or more other pumps of the plurality of pumps to compensate for the first pump.

10. The method of claim 9, further comprising:

selecting the one or more other pumps to adjust based at least in part on the conditions of the one or more other pumps as indicated by one or more of the one or more parameters.

11. The method of claim 7, further comprising:

determining that the one or more parameters are indicative of a potential failure condition; and determining a source of the potential failure condition.

12. The method of claim 11, further comprising:

generating an alert or notification indicative of the potential failure condition and the source.

13. The method of claim 7, further comprising:

logging operation data including a number of strokes and pumping hours performed by a pump of a plurality of pumps, wherein the plurality of components includes the plurality of pumps; and determining a maintenance schedule based at least in part on the operation data.

14. A hydraulic fracturing method, comprising:

measuring one or more operational parameters of a plurality of components of a hydraulic fracturing system;

transmitting a first parameter of the one or more operational parameters from a first component of the hydraulic fracturing system to a second component of the hydraulic fracturing system;

detecting that the first parameter is outside of an acceptable threshold;

generating automated instructions at the second device based at least in part on the first parameter; and controlling one or more functions of the hydraulic fracturing system based on the automated instructions.

15. The method of claim 14, further comprising:

automatically adjusting one or more functions of the second device based on the automated instructions.

16. The method of claim 14, wherein the first parameter includes measurements of one or more of a plurality of pumps, wherein the plurality of components includes the plurality of pumps.

17. The method of claim 14, further comprising:

controlling one or more of a plurality of pumps individually based on the automated instructions, wherein the plurality of components includes the plurality of pumps.

18. The method of claim 17, further comprising:

detecting that a measurement associated with a first pump of the plurality of pumps is outside of an acceptable threshold; and automatically taking the first pump offline in response to the detection.

19. The method of claim 18, further comprising:

adjusting one or more of the other pumps in the plurality of pumps to compensate for taking the first pump offline.

20. The method of claim 14, further comprising:

determining that the one or more operational parameters are indicative of a potential failure condition; and determining a source of the potential failure condition.

* * * * *